US011534822B2

(12) United States Patent
Marguillier et al.

(10) Patent No.: US 11,534,822 B2
(45) Date of Patent: Dec. 27, 2022

(54) COMPOSITE WEAR PART

(71) Applicant: Magotteaux International S.A., Vaux-sous-Chevremont (BE)

(72) Inventors: David Marguillier, Romsée (BE); Benoît Clermont, Grivegnée (BE); Michel Tran, Vaux-sous-Chèvremont (BE)

(73) Assignee: Magotteaux International S.A., Vaux-sous-Chevremont (BE)

( * ) Notice: Subject to any disclaimer, the term of this patent is extended or adjusted under 35 U.S.C. 154(b) by 0 days.

(21) Appl. No.: 17/546,688

(22) Filed: Dec. 9, 2021

(65) Prior Publication Data

US 2022/0097128 A1 Mar. 31, 2022

Related U.S. Application Data

(63) Continuation of application No. PCT/EP2021/051040, filed on Jan. 19, 2021.

(30) Foreign Application Priority Data

Feb. 11, 2020 (BE) ..... 20205083

(51) Int. Cl.

| | |
|---|---|
| ***B32B 3/10*** | (2006.01) |
| ***B22D 19/02*** | (2006.01) |
| ***C22C 29/00*** | (2006.01) |

(52) U.S. Cl.

CPC ..... *B22D 19/02* (2013.01); *C22C 29/00* (2013.01); *Y10T 428/12007* (2015.01); *Y10T 428/12486* (2015.01)

(58) Field of Classification Search

None

See application file for complete search history.

(56) References Cited

U.S. PATENT DOCUMENTS

| | | | |
|---|---|---|---|
| 4,119,459 | A | 10/1978 | Ekemar et al. |
| 4,606,506 | A | 8/1986 | Okada et al. |
| 4,626,464 | A | 12/1986 | Jachowski et al. |
| 5,066,546 | A | 11/1991 | Materkowski |

(Continued)

FOREIGN PATENT DOCUMENTS

| | | | |
|---|---|---|---|
| CN | 104549654 | A | 4/2015 |
| CN | 205020152 | U | 2/2016 |

(Continued)

OTHER PUBLICATIONS

International Search Report and Written Opinion of the International Searching Authority from the European Receiving Office in PCT/EP2021/051040 dated Mar. 15, 2021, which is an international application corresponding to this U.S. application.

*Primary Examiner* — Seth Dumbris
*Assistant Examiner* — Kim S. Horger
(74) *Attorney, Agent, or Firm* — Kolitch Romano Dascenzo Gates LLC

(57) ABSTRACT

A composite wear part may include a ferrous alloy matrix and at least one ceramic reinforcement in the form of an insert having an openwork structure. The openwork structure includes a plurality of blind holes. The blind sides of the holes are positioned on the side of the composite wear part most exposed to wear.

15 Claims, 8 Drawing Sheets

(56) References Cited

U.S. PATENT DOCUMENTS

| | | | | |
|---|---|---|---|---|
| RE39,998 | E * | 1/2008 | Francois | B22D 19/08 428/614 |
| 7,438,247 | B2 | 10/2008 | Leclercq | |
| 8,999,518 | B2 | 4/2015 | Vescera | |
| 2007/0043349 | A1 | 2/2007 | Swanson et al. | |
| 2011/0229715 | A1 | 9/2011 | Vescera | |
| 2011/0259184 | A1 | 10/2011 | Adams et al. | |
| 2012/0186919 | A1* | 7/2012 | Hanna | B22D 25/02 188/218 XL |
| 2018/0369905 | A1 | 12/2018 | Olejnik et al. | |

FOREIGN PATENT DOCUMENTS

| | | | |
|---|---|---|---|
| CN | 108262465 | A | 7/2018 |
| CN | 108380850 | A | 8/2018 |
| CN | 108746556 | A | 11/2018 |
| CN | 108746557 | A | 11/2018 |
| DE | 19653800 | A1 | 8/1997 |
| EP | 1570905 | A1 | 9/2005 |
| EP | 2450132 | A2 | 5/2012 |
| JP | S6297758 | A | 5/1987 |
| JP | S62252657 | A | 11/1987 |
| JP | 2002542035 | A | 12/2002 |
| JP | 2009183877 | A | 8/2009 |
| JP | 2012035157 | A | 2/2012 |
| RU | 2357801 | C2 | 6/2009 |
| WO | 9605005 | A1 | 8/1996 |
| WO | 9815373 | A1 | 4/1998 |
| WO | 03047791 | A1 | 6/2003 |
| WO | 2010031660 | A1 | 3/2010 |
| WO | 2010031661 | A1 | 3/2010 |
| WO | 2010031662 | A1 | 3/2010 |
| WO | 2010031663 | A1 | 3/2010 |
| WO | 2014125034 | A1 | 8/2014 |
| WO | 2015015507 | A1 | 2/2015 |
| WO | 2015162047 | A1 | 10/2015 |
| WO | 2018069006 | A1 | 4/2018 |

* cited by examiner

COMPOSITE WEAR PART

INTRODUCTION

Composite wear parts made by foundry casting are well known in the prior art. These are mainly cast iron parts reinforced selectively on the faces most exposed to wear by ceramics of the alumina-zirconia type, or by carbides, nitrides or other intermetallic elements arranged according to specific three-dimensional geometries within the metal matrix.

The particular arrangement of the reinforcement structures makes it possible to create hierarchical composites with differentiated reinforcements according to the arrangement or geometric shape of the reinforcement particles or structures. In this way, it is possible to make ceramic wafers in the form of hollow honeycomb-type structures or millimetric granule aggregates arranged as "padding" inside a sand mold on the most stressed side of the part, with interstices allowing infiltration by molten iron during the casting process.

There are two main types of composite parts made in foundries where the ceramic is positioned according to a specific three-dimensional geometry in a mold before the casting of the iron: one in which the ceramic is formed before the casting and one in which the ceramic is formed during the casting by a self-propagating thermal reaction from reagents present in the mold.

Thus, a composite wear part can, on the one hand, be reinforced with, for example, titanium carbide that has already been formed, which can be placed in the mold before casting and whose interstices are simply infiltrated by the casting metal at around 1500° C., and, on the other hand, be reinforced with titanium carbide which will be formed in situ from the titanium and carbon reagents previously mixed in powder form and forming TiC by a self-propagating thermal reaction at around 2500° C., the reaction being initiated by the casting metal, which will then be drawn by capillary action into the reinforcing ceramic structure to fill the interstices.

Document WO98/15373 discloses a composite wear part with an alumina-zirconia based ceramic reinforcement in a honeycomb shape.

Document WO03/047791 discloses a composite wear part with carbide, nitride, oxide ceramics or intermetallic elements formed in situ according to a self-propagating thermal reaction initiated by the molten cast iron which then infiltrates said ceramic structure once formed.

Documents WO2010/031660; WO2010/031661; WO2010/031663; WO 2010/031662 disclose hierarchical composite wear parts reinforced with titanium carbide formed in situ where the reactants are introduced as granules into the mold. The wear parts are illustrated as dredge teeth, cones, and crushing hammers.

Document WO2018/069006 discloses a grinding roller where the wear areas are differentially reinforced depending on the wear stress.

SUMMARY

The present disclosure relates to composite wear parts made by foundry casting of a ferrous alloy. More particularly, it relates to a wear part reinforced by a three-dimensional ceramic recessed structure integrated into the wear part, and a geometric structure adapted to wear stress. It also discloses a method of manufacturing the wear part.

A composite wear part is provided with a ceramic reinforcement insert having an improved geometry, where both structure and positioning are adapted to the wear stress. It is intended to re-create a resistant structure after initial wear of the ceramic reinforcement on the most stressed side (e.g., the face or side most exposed to wear) of the wear part.

The present teachings disclose a composite wear part comprising a ferrous alloy matrix and at least one ceramic reinforcement in the form of an insert with an openwork structure, the openwork structure comprising blind holes, the blind side of the holes being positioned on the most stressed side of said wear part.

The preferred embodiments of the present disclosure include at least one, or any suitable combination of the following features:

- the ceramic insert comprises at least two areas (A, B), the more stressed area (A) comprising a majority of blind holes and the less stressed area (B) comprising a majority of through holes,
- the section of the holes of the ceramic insert in the area (A) is smaller than the section in the area (B) of said wear part,
- the total section of the openings in the insert on side (A) is smaller than the total section of the openings on side (B),
- the blind side of the ceramic insert is partially or entirely formed by a ceramic which has a different composition than that forming the area (B) with the through holes,
- the insert comprises at least two superimposed ceramic reinforcement structures (D, E) in the area (A),
- the blind holes are arranged obliquely in the insert,
- the blind holes have a frustoconical shape,
- the ceramic insert comprises alumina-zirconia,
- the ceramic insert comprises carbides formed in situ by a self-propagating exothermic reaction, preferably titanium carbide,
- the ceramic insert comprises grains of a ceramic-metal composite (CERMET),
- the ceramic structure comprises alumina-zirconia in proportions of alumina ranging from 10 to 90% by volume and zirconia ranging from 90 to 10% by volume, zirconia being optionally stabilized with yttria.

The present teachings also discloses a method for producing a wear part according to the present disclosure, comprising the following steps:

providing a mold for making a wear part by casting a ferrous alloy, placing an insert according to the present disclosure in the form of a an aggregate of millimetric granules of ceramic material or infiltrable ceramic material precursors in the mold with the blind side on the most stressed side of the wear part, infiltration of the insert by the molten ferrous alloy.

The method according to the present disclosure is preferably implemented with:

a ferrous alloy comprising steel or cast iron, millimetric ceramic granule aggregates or infiltrable ceramic precursor aggregates are selected from the following compositions:

Alumina-zirconia in proportions of 90/10 to 10/90, zirconia being optionally stabilized with yttria, Carbon and titanium powder optionally comprising iron powder as a moderator of the reaction initiated by the casting of the ferrous alloy, Ceramic-metal composites (CERMET).

BRIEF DESCRIPTION OF THE DRAWINGS

In the figures discussed below, "inserts" are defined as infiltrable three-dimensional structures formed of more-or-less porous aggregates or agglomerates of millimeter-sized particles with interstices.

For ease of representation, the figures illustrate only the three-dimensional outline of these inserts, placed in the reinforced portions of the wear part.

LIST OF REFERENCE SYMBOLS

Figure 1:
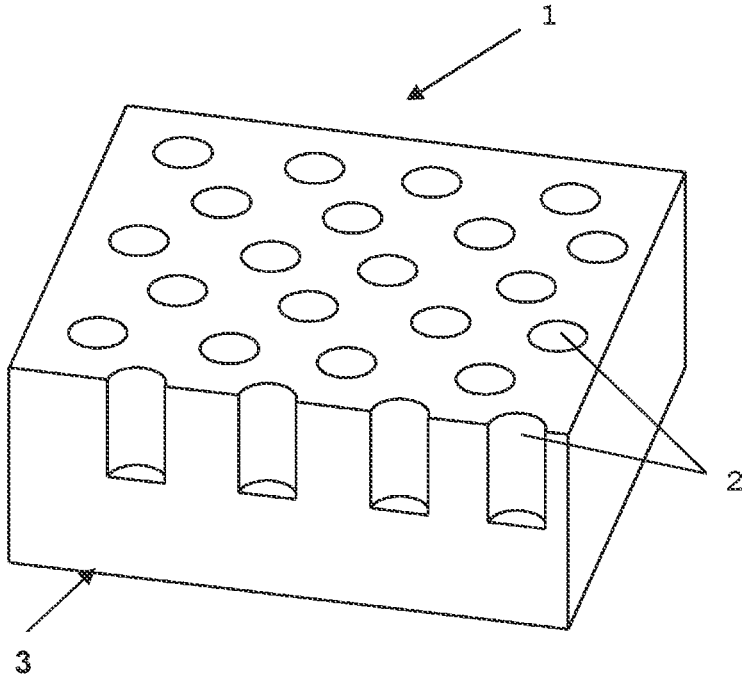
FIG. 1 represents the element of a ceramic insert with blind holes according to the present disclosure. The insert is here schematically shown in its simplest form. Such an insert is positioned with the blind side on the face most exposed to wear. Such an insert has numerous interstices, or pores (not illustrated) which are intended to be infiltrated by the ferrous alloy during casting.
Figure 2:
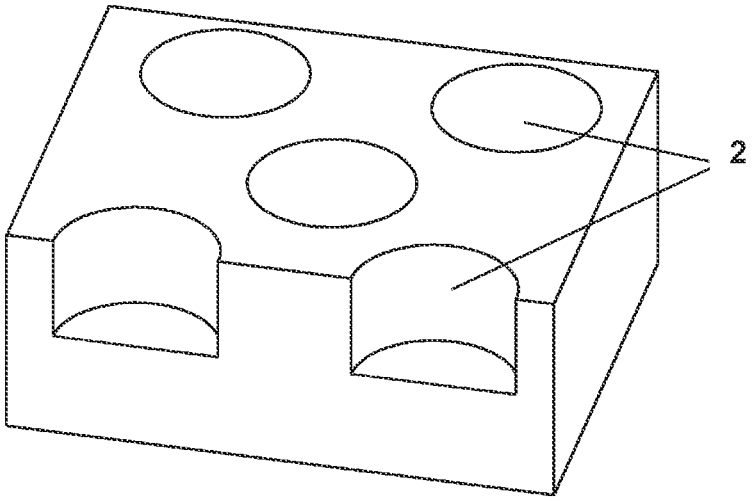
FIG. 2 represents a ceramic insert based on the same principle as that described in FIG. 1, but with larger blind holes illustrating the different possibilities of making blind holes in such a ceramic insert.
Figure 3:
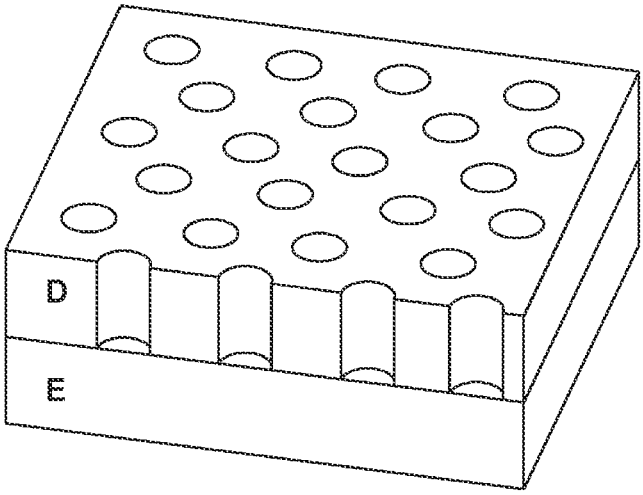
FIG. 3 represents a ceramic insert with blind holes based on the same principle as that described in FIG. 1, but this time the insert has two different ceramic layers D and E.
Figure 4:
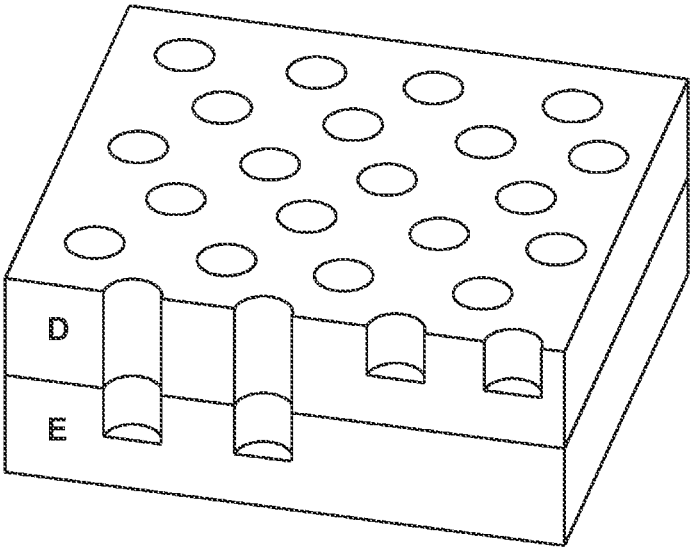
FIG. 4 represents a ceramic insert with blind holes based on the same principle as that described in FIG. 3, but this time with deeper blind holes penetrating into the second layer E.
Figure 5:
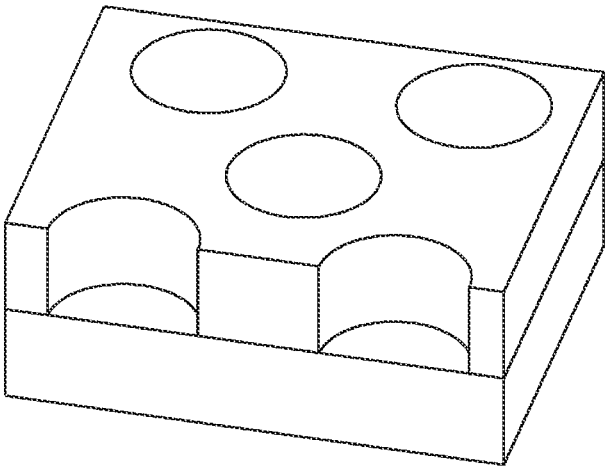
FIG. 5 represents a ceramic insert with blind holes based on the same principle as that described in FIG. 3, but this time made with enlarged holes.
Figure 6:
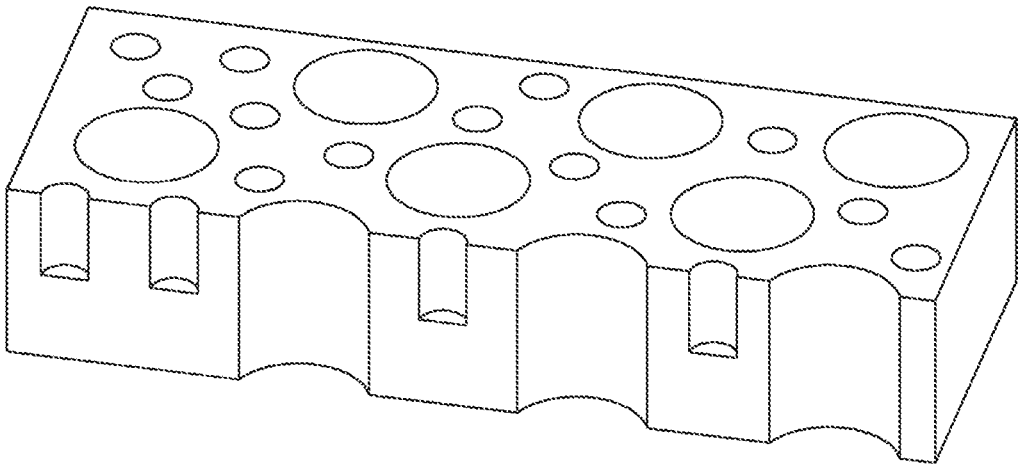
FIG. 6 represents a ceramic insert with blind holes based on the same principle as that described in FIG. 1, but this time with blind holes combined in approximately equal proportions with through holes of larger section.
Figure 7:
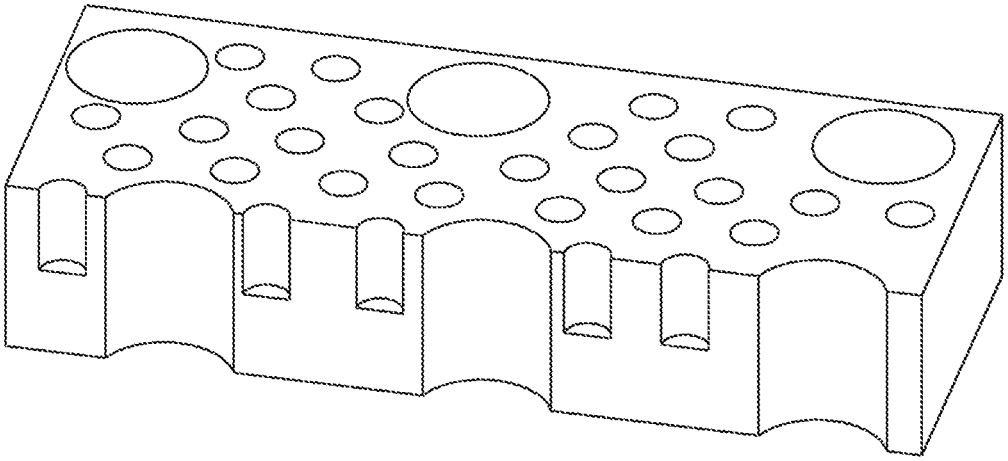
FIG. 7 represents a ceramic insert with blind holes based on the same principle as that described in FIG. 1, but this time with blind holes combined in a minor proportion with through holes of larger section. Here the blind holes, which have a smaller diameter than the through holes, are in the majority.
Figure 8:
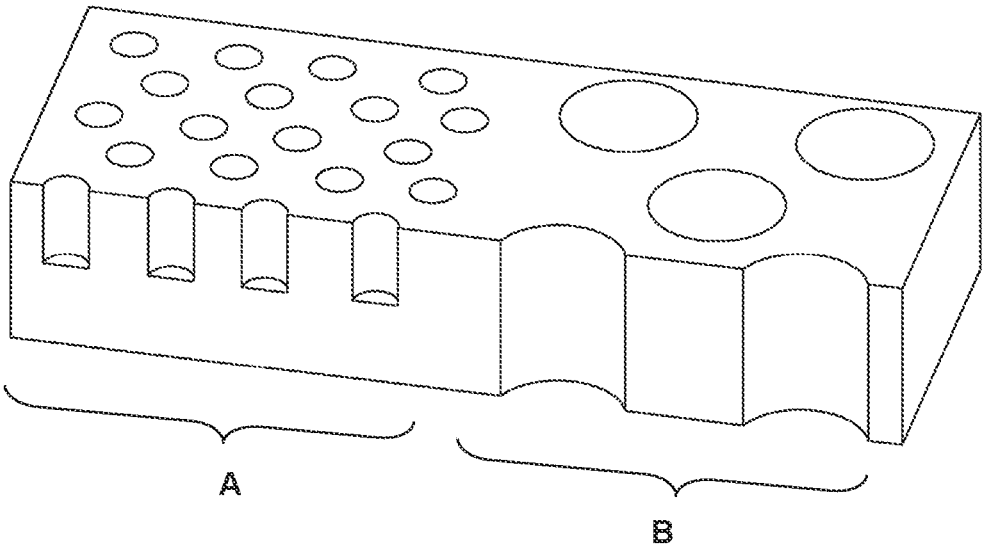
FIG. 8 represents a ceramic insert with two different stress areas A and B. Area A, which is more exposed to wear, comprises mainly blind holes, and area B, which is less exposed to wear, comprises mainly through holes. The through holes in area B have a larger section than the blind holes.
Figure 9:
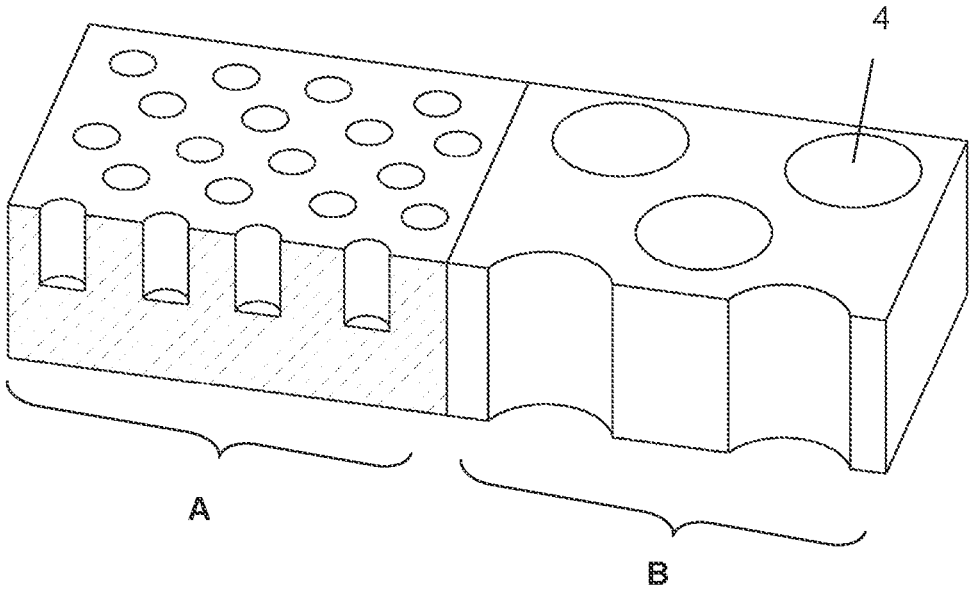
FIG. 9 represents the same configuration as FIG. 8, but this time with a different ceramic on side A and side B.
Figure 10:
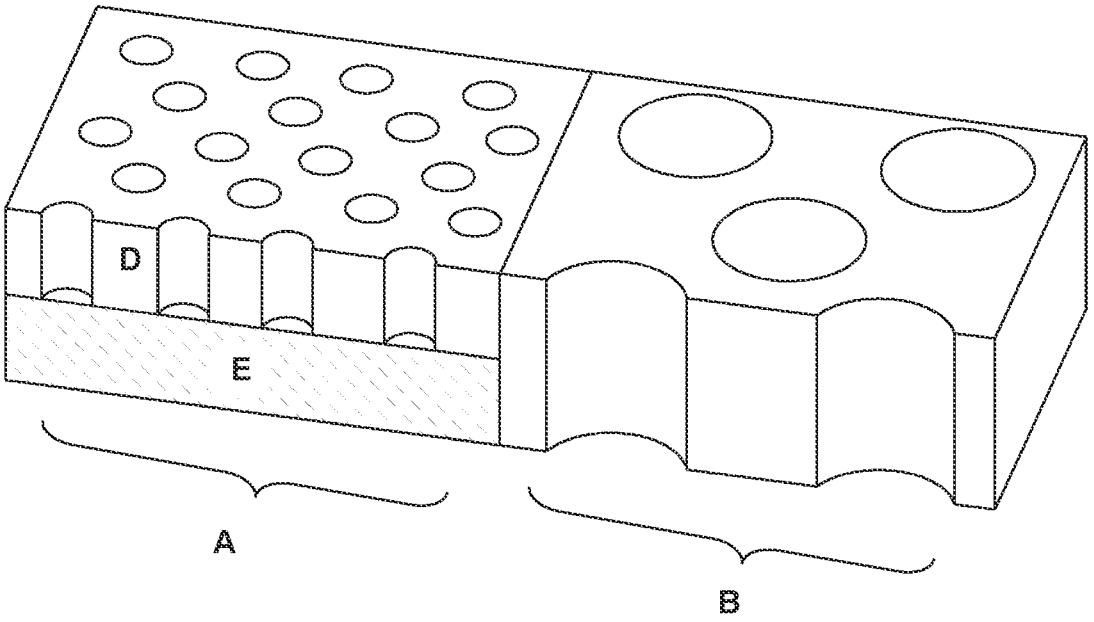
FIG. 10 represents the same configuration as FIG. 8, but this time not only with a different ceramic on side A and side B, but also with two different ceramic layers D and E in area A, with a more wear-resistant ceramic on the blind side of area A.
Figure 11:
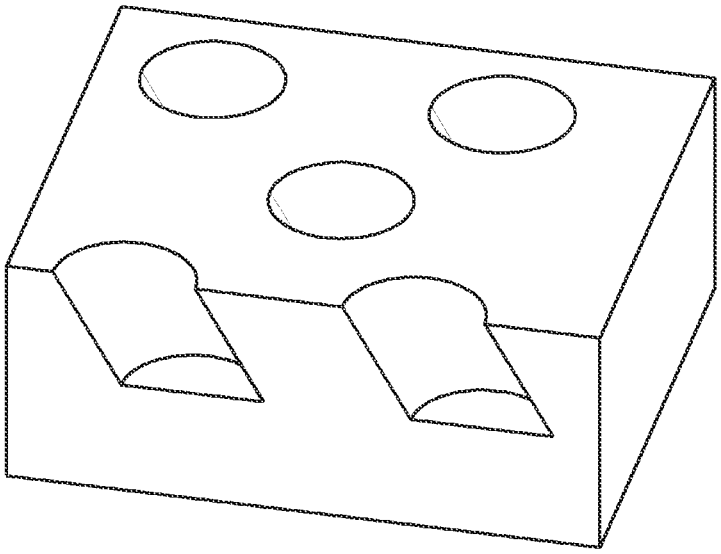
FIG. 11 represents a ceramic insert according to the present disclosure with obliquely positioned blind holes.
Figure 12:
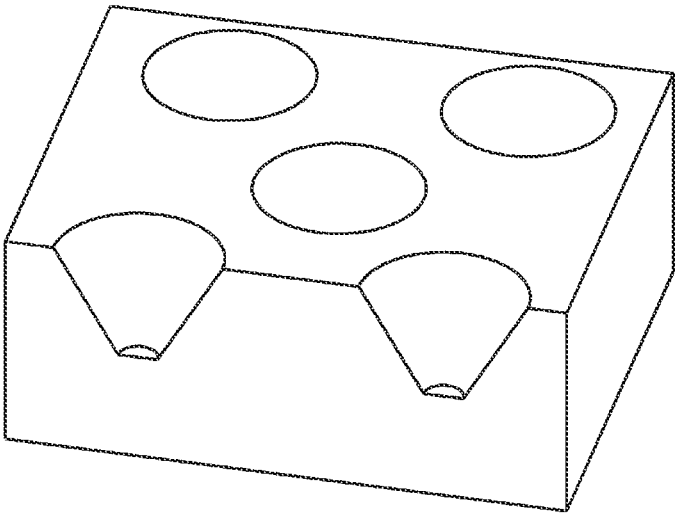
FIG. 12 represents a ceramic insert according to the present disclosure with blind holes in a frustoconical shape.
Figure 13:
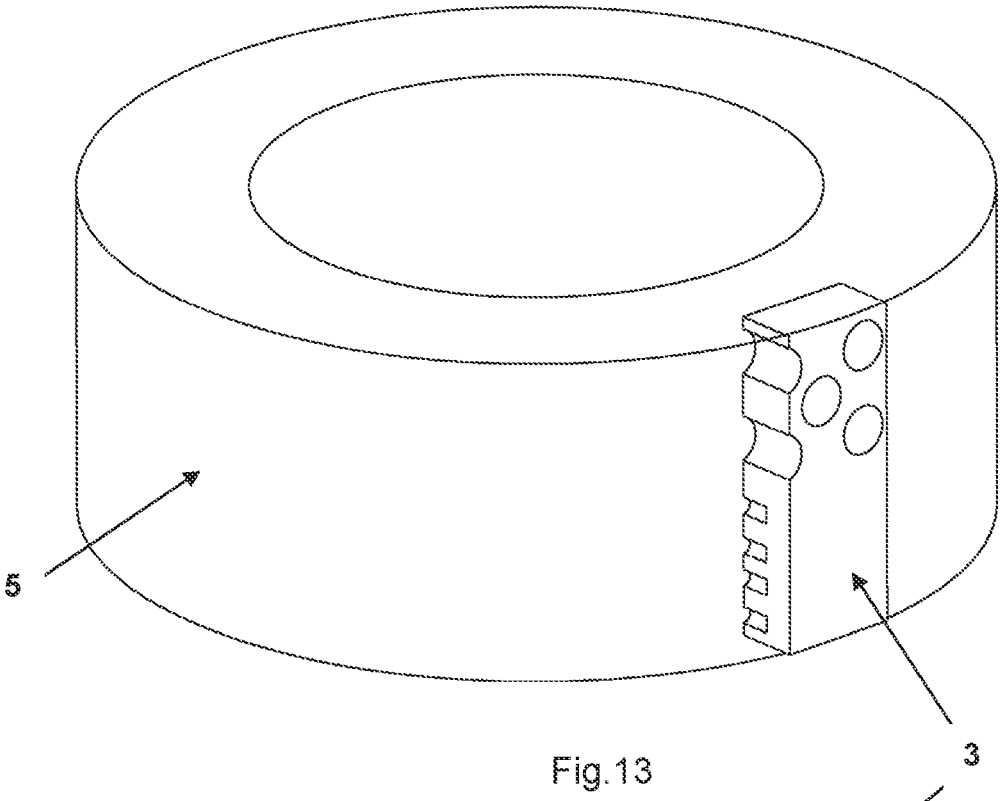
FIG. 13 represents an illustrative example of a wear part according to the present disclosure in the form of a grinding roller for a vertical rotary grinder where the area A most exposed to wear comprises the ceramic insert with blind holes. Area A is adjacent to a less wear-exposed area B comprising through holes.
Figure 14:
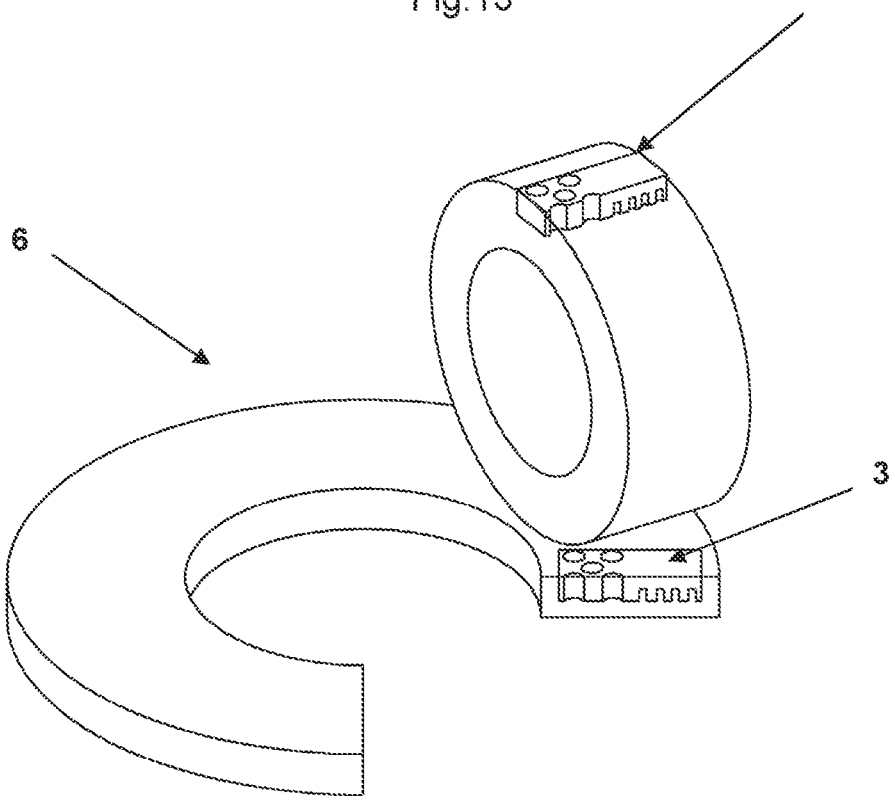
FIG. 14 schematically represents the use of a grinding roller on a table of a vertical rotary grinder.
Figure 15:
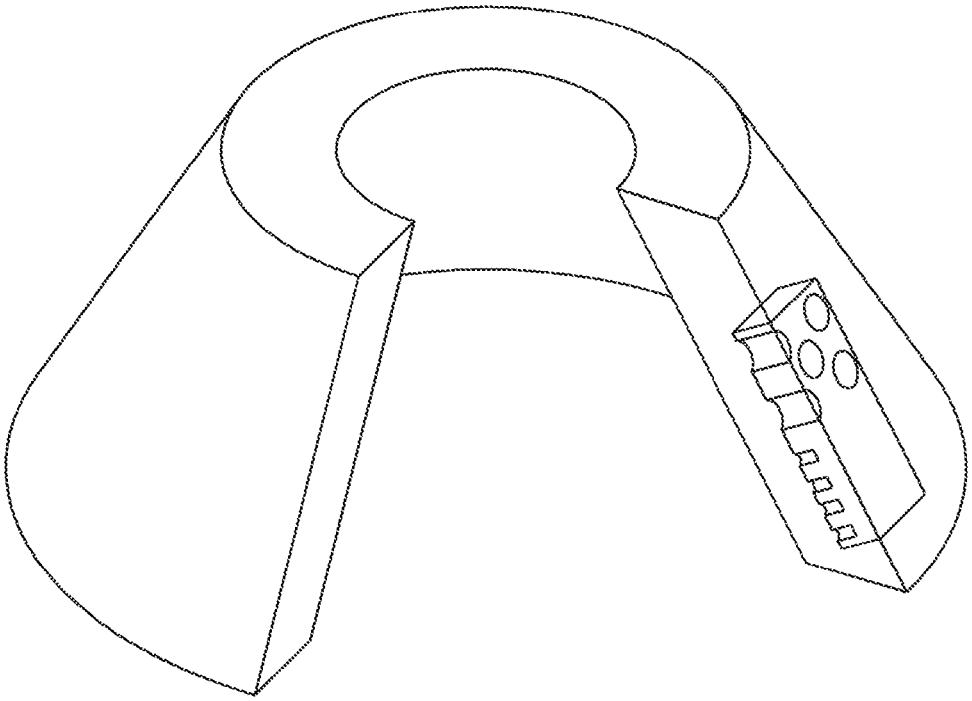
FIG. 15 schematically represents a grinding cone with a ceramic insert with blind holes.

1: Ceramic insert
2: Blind holes
3: Most stressed face of the wear part
4: Through holes
5: Grinding roller
6: Schematic representation of a vertical rotary grinder with grinding roller and grinding table
A: Most stressed area of the wear part
B: Least stressed area of the wear part
D: Upper layer of the ceramic insert
E: Lower layer of the ceramic insert oriented towards the side most exposed to wear

DETAILED DESCRIPTION

Wear parts cast in foundries are very common in the mining industry, for grinding rocks and ores, or in the field of dredging. Without being restrictive, these may include, in the case of rock grinding, composite impactors for impact crushers, mobile cones for compression crushers, or roller tables for vertical compression grinders.

The stresses with which the wear parts in these machines are confronted are both impact resistance and wear resistance. For this reason, the hardness of a ceramic material (carbides, nitrides, oxides of various types, etc.), which is wear resistant but not impact resistant, is usually combined with a ferrous alloy such as cast iron or steel, which provides a certain level of ductility to resist impact but is less wear resistant.

Combining these two types of material is not easy, however, because they have very different coefficients of expansion which can generate micro-cracks when the parts are cooled and which, because of these potential defects, cancel out this synergy effect in a composite wear part.

An additional difficulty lies in the problem of the complete infiltration of the ceramic insert by the molten cast iron, which tends to cool in contact with it, thus preventing satisfactory infiltration (except for the reactions of in situ ceramic formation by self-propagating exothermic reaction).

Many configurations of ceramic inserts have been tested by the industry. The most popular insert is a relatively easy-to-infiltrate "honeycomb" shape, where areas of high ceramic concentration alternate with areas of low ceramic concentration.

Ceramic reinforcements are typically introduced as a prefabricated ceramic insert or even as an insert in which the interstices have already been filled with molten cast iron and cooled before being re-introduced into a mold to cast the desired wear part.

There is a great deal of know-how involved in the production of a ceramic insert, as it must have a porous structure to be infiltrated by the molten cast iron, the level of porosity being decisive, which has led to a whole series of technologies for the manufacture of powder agglomerates (aggregates) in the form of clogged grains of a few millimeters in diameter, which are then assembled into a "padding" structure with more-or-less large interstices, depending in particular on the thickness of the insert to be infiltrated and its position in the mold.

There are many compositional possibilities for producing an insert according to the present disclosure. In a non-exhaustive list, these may include:

- alumina-zirconia 10/90 to 90/10 with or without stabilization in the form of millimetric granules assembled into aggregates in an infiltrable structure.
- particles from ground CERMET based on carbides, nitrides, borides or intermetallic elements for example, then agglomerated in an infiltrable porous structure.
- ceramics formed by self-propagating exothermic synthesis (SHS) such as titanium carbide from carbon and titanium powders, possibly mixed with a powder to moderate the reaction such as iron powder which can be present in the form of agglomerated millimetric grains with interstices. The reaction between the carbon and the titanium is initiated by the casting of the ferrous alloy.
- etc.

Holding the insert in the mold during casting also requires a certain know-how acquired by the industry over the years.

The configuration and positioning of ceramic inserts within a composite wear part has been the subject of much research, all of which has led to the observation that the wear rate results obtained during the tests are relatively unpredictable because they depend on the specific application, i.e., the type of machine used and the type of rock to be ground, or the intermittence of use.

The situation is made even more complex by the fact that during the wear phenomenon, the geometry of the wear part changes and the areas that are not very stressed at the beginning become much more so as wear progresses. Thus, a compromise regarding the structure of the insert is often required to reconcile short- and long-term wear, both of which can vary considerably from case to case.

The inventors of the present disclosure have now produced a ceramic insert structure that perfectly reaches this compromise. This includes an openwork structure with blind holes, the blind side being placed on the most stressed side of the wear part (i.e., the face or side most exposed to wear), so as to provide high resistance to wear in the beginning of use. When the blind side (closed bottom of the holes) has been worn away, resistance is provided to both impact and wear, owing to the through holes.

The holes made in the structure of the insert have a diameter generally between 1 and 10 cm, preferably between 1 and 8 cm and more preferably between 1 and 4 cm.

The depth of the blind holes depends on the total thickness of the insert and the specific use, and generally represents between 20 and 85% of the total thickness, preferably between 30 and 80% and more preferably between 40 and 70%.

The insert can be made in several superimposed layers (D and E) or with adjacent parts (A and B). Thus, the blind side may be made of a ceramic that has a different composition than the one including the holes superimposed on it or adjacent to it (see figures).

Although a round cross-section is preferred for the holes, it is clear that the holes are not limited to this shape. Thus, the holes may have any suitable cross-sectional shape, such as hexagonal, squares, or any shape.

A partially recessed insert with blind holes is also contemplated, where blind holes are adjacent or next to through holes. The proportion of blind holes should, however, be significant, i.e., greater than 20%, preferably greater than 40% and more preferably greater than 60%.

When the insert is formed of two adjacent areas, one comprising mainly blind holes and the other comprising mainly through holes, the blind holes in the most stressed area of the wear part have a smaller section and/or opening surface than the holes in the less stressed area.

A general concept of the present disclosure lies in the fact that the first wear occurs on a side reinforced by an insert which is mainly free of holes, in this case the blind side of the insert. Once worn, the insert still offers a high resistance to wear with through holes having a section which is smaller than the sections of the through holes on the less stressed side of the wear part.

Although the disclosure is not limited to a specific ceramic composition, ceramics based on alumina-zirconia or titanium carbide, placed as is in the mold (cermet grains) or formed in situ by the self-propagating thermal reaction are preferred. Alumina-zirconia proportions comprising 10-90% alumina and 90-10% zirconia by volume are preferred, zirconia being optionally stabilized with yttria.

EXAMPLES

The present disclosure has been illustrated by a roller of a vertical rotary grinder and moving parts of a cone crusher which have been made with, on the one hand, an insert including through holes according to the prior art and, on the other hand, with inserts including blind holes according to the present disclosure.

The wear rate was compared under the following conditions:

Machine type: Secondary cone crusher
Type of wear part: Moving part
Type of ground material: Rhyolite 50-150 mm
Number of operating hours with and without through-hole inserts on the most stressed part:

| Cone crusher | Service life | Superiority factor (SF) |
|---|---|---|
| Through-hole inserts | 220 H | 1 |
| Blind hole inserts | 308 H | 1.4 |

Type of machine: Vertical grinder
Type of wearing part: Roller
Type of ground material: Silico-lime
Number of operating hours with and without through-hole inserts on the most stressed part:

| Vertical grinder | Wear rate | Superiority factor (SF) |
|---|---|---|
| Through-hole inserts | 32 mm/kh | 1 |
| Blind hole inserts | 21 mm/kh | 1.5 |

Illustrative Combinations and Additional Examples

This section describes additional aspects and features of wear parts and inserts of the present disclosure, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A composite wear part comprising a ferrous alloy matrix and at least one ceramic reinforcement in the form of an insert (1) with an openwork structure, the openwork structure comprising blind holes (2), the blind side of the holes being positioned on the most stressed side (3) of said wear part.

A1. The composite wear part according to A0, wherein said ceramic insert comprises at least two areas (A, B), the more stressed area (A) comprising a majority of blind holes (2) and the less stressed area (B) comprising a majority of through holes (4).

A2. The composite wear part according to A0 or A1, in which the section of the holes of the ceramic insert (1) in the area (A) is smaller than the section in the area (B) of said wear part.

A3. The composite wear part according to any one of paragraphs A0 through A2, wherein the total section of the openings in the insert (1) on side (A) is smaller than the total section of the openings on side (B).

A4. The composite wear part according to any one of paragraphs A0 through A3, wherein the blind side of the ceramic insert (1) is partially or entirely formed by a ceramic which has a different composition than that forming the area (B) with the through holes (4).

A5. The composite wear part according to any one of paragraphs A0 through A4, wherein there are at least two superimposed ceramic reinforcement structures (D, E) in the area (A).

A6. The composite wear part according to any one of paragraphs A0 through A5, wherein the blind holes are obliquely arranged in the insert.

A7. The composite wear part according to any one of paragraphs A0 through A6, wherein the blind holes have a frustoconical shape.

A8. The composite wear part according to any one of paragraphs A0 through A7, wherein the ceramic insert (1) comprises alumina-zirconia.

A9. The composite wear part according to any one of paragraphs A0 through A8, wherein the ceramic insert (1) comprises carbides formed in situ by a self-propagating exothermic reaction, preferably titanium carbide.

A10. The composite wear part according to any one of paragraphs A0 through A9, wherein the ceramic insert (1) comprises grains of a ceramic-metal composite (CERMET).

A11. The composite wear part according to any one of paragraphs A0 through A10, wherein the ceramic structure comprises alumina-zirconia in proportions of alumina ranging from 10 to 90% by volume and zirconia ranging from 90 to 10% by volume, zirconia being optionally stabilized with yttria.

B0. A method for making a wear part according to any one of paragraphs A0 through A11, comprising the following steps:

providing a mold for making a wear part by casting a ferrous alloy, placing an insert according to any one of paragraphs A0 through 11 in the form of an aggregate of millimetric granules of ceramic material or infiltrable ceramic material precursors in the mold with the blind side on the most stressed side of the wear part, infiltration of the insert by the molten ferrous alloy.

B1. The method according to B0, wherein the ferrous alloy comprises steel or cast iron.

B2. The method according to B0 or B1, wherein the millimetric ceramic granule aggregates or infiltrable ceramic precursor aggregates are selected from the following compositions:

Alumina-zirconia in proportions of 90/10 to 10/90, zirconia being optionally stabilized with yttria, Carbon and titanium powder optionally comprising iron powder as a moderator of the reaction initiated by the casting of the ferrous alloy, and Ceramic-metal composites (CERMET).

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A composite wear part, comprising:

a ferrous alloy matrix and at least one ceramic reinforcement insert having an openwork structure, the openwork structure of the ceramic reinforcement insert comprising blind holes;

wherein blind ends of the blind holes are positioned on a side of the composite wear part most exposed to wear;

wherein the ceramic reinforcement insert comprises at least two adjacent areas having openings, wherein the openings comprise the blind holes and through holes:

a first area, and a second area, wherein the first area is configured to experience more stress than the second area.

2. The composite wear part according to claim 1, wherein the first area comprises a majority of the blind holes, and wherein the second area comprises a majority of the through holes.

3. The composite wear part according to claim 2, wherein a cross-sectional area of each of the blind holes of the ceramic reinforcement insert in the first area is smaller than a cross-sectional area of each of the through holes in the second area of the composite wear part.

4. The composite wear part of claim 2, wherein a total cross-sectional area of the openings in the ceramic reinforcement insert in the first area is smaller than a total cross-sectional area of the openings in the second area.

5. The composite wear part of claim 2, wherein a side of the ceramic reinforcement insert comprising the blind ends of the blind holes is at least partially formed by a ceramic having a different composition than a ceramic forming the second area.

6. The composite wear part of claim 2, wherein the first area further comprises a second ceramic reinforcement structure superimposed onto the at least one ceramic reinforcement insert.

7. The composite wear part of claim 1, wherein the blind holes are obliquely arranged in the ceramic reinforcement insert.

8. The composite wear part of claim 1, wherein the blind holes have a frustoconical shape.

9. The composite wear part of claim 1, wherein the ceramic reinforcement insert comprises alumina-zirconia.

10. The composite wear part of claim 1, wherein the ceramic reinforcement insert comprises carbides formed in situ by a self-propagating exothermic reaction.

11. The composite wear part of claim 10, wherein the carbides formed in situ comprise titanium carbide.

12. The composite wear part of claim 1, wherein the ceramic reinforcement insert comprises grains of a ceramic-metal composite (CERMET).

13. The composite wear part of claim 1, wherein the ceramic openwork structure comprises alumina-zirconia in proportions of alumina ranging from 10 to 90% by volume and zirconia ranging from 90 to 10% by volume.

14. The composite wear part of claim 13, wherein the zirconia is stabilized with yttria.

15. A composite wear part, comprising:

a ferrous alloy matrix and at least one ceramic reinforcement insert having an openwork structure, the openwork structure comprising a plurality of blind holes;

wherein the blind holes are oriented such that closed bottoms of the blind holes are toward a face of the composite wear part most exposed to wear;

wherein the ceramic reinforcement insert comprises at least two adjacent zones having openings, wherein the openings comprise the plurality of blind holes and a plurality of through holes: a first zone comprising a majority of the blind holes, and a second zone comprising a majority of the through holes; and wherein the first zone is configured to provide higher resistance to wear than the second zone.

* * * * *